United States Patent [19]

Simpson et al.

[11] Patent Number: 4,815,238

[45] Date of Patent: Mar. 28, 1989

[54] DEBRIS COLLECTOR FOR A WIDE BELT SANDER AND THE LIKE

[75] Inventors: Steven C. Simpson; Ronald D. Witt, both of Kansas City, Mo.

[73] Assignee: Pro-Kleen Systems International, Ltd., Overland Park, Kans.

[21] Appl. No.: 179,070

[22] Filed: Apr. 8, 1988

Related U.S. Application Data

[63] Continuation of Ser. No. 037,952, Apr. 13, 1987, abandoned.

[51] Int. Cl.[4] ..... B24B 21/18

[52] U.S. Cl. ..... 51/135 R; 51/138; 51/262 A; 51/270

[58] Field of Search ..... 51/135 R, 137, 138, 51/139, 140, 262 A, 270, 424, 425; 144/252 R, 252 A

[56] References Cited

U.S. PATENT DOCUMENTS

| | | | |
|---|---|---|---|
| 1,248,157 | 11/1917 | Piper | 51/270 |
| 1,701,815 | 2/1919 | Maddox | 51/72 R |
| 1,773,374 | 8/1930 | Ruemelin | 51/425 |
| 2,015,603 | 9/1935 | Maris | 15/269 |
| 2,280,767 | 4/1942 | Ferragano | 51/187 |
| 2,442,088 | 5/1948 | Kreutzer | 51/205 |
| 2,647,272 | 8/1953 | Holmes | 15/53 |
| 2,665,531 | 1/1954 | Sivertsen | 51/262 |
| 3,097,457 | 7/1963 | Seligman | 51/246 |
| 3,098,332 | 7/1963 | Sutton | 51/270 |
| 3,123,950 | 3/1964 | Kuris et al. | 51/262 |
| 3,525,183 | 8/1970 | Gargrave | 51/270 |
| 3,812,622 | 5/1974 | Parsons | 51/5 |
| 4,151,705 | 5/1979 | Evans | 51/139 |
| 4,182,082 | 1/1980 | Meyer | 51/5 D |
| 4,293,970 | 10/1981 | Bencene et al. | 15/21 D |
| 4,356,671 | 11/1982 | Gabrielson et al. | 51/325 |
| 4,438,601 | 3/1984 | Olson | 51/262 H |
| 4,483,103 | 11/1984 | Bickel | 51/165.87 |
| 4,525,955 | 7/1985 | Cothrell et al. | 51/135 R |
| 4,539,779 | 9/1985 | Donner | 51/325 |

FOREIGN PATENT DOCUMENTS

| | | | |
|---|---|---|---|
| 86325 | 8/1955 | Norway | 51/270 |

*Primary Examiner*—Robert P. Olszewski

*Attorney, Agent, or Firm*—Kokjer, Kircher, Bradley, Wharton, Bowman & Johnson

[57] ABSTRACT

A debris collector for wide belt sanders and the like including an upper assembly. A plurality of posts include upper ends connected to the upper assembly and lower ends connected to a lower assembly. A bag assembly extends between the upper and lower assemblies and is shaped to receive debris.

11 Claims, 2 Drawing Sheets

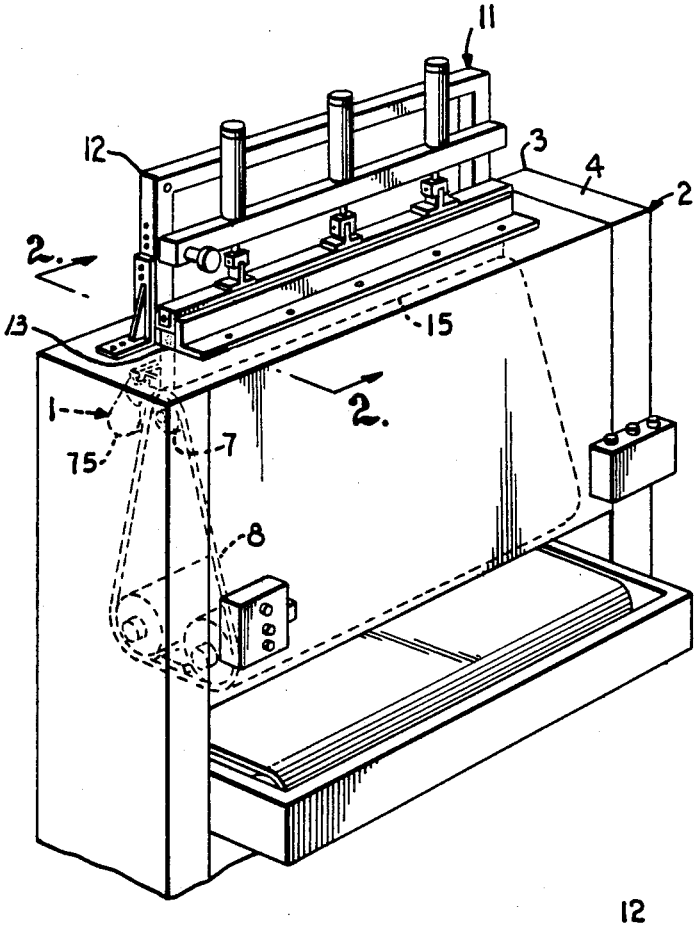
Fig. 1.
Fig. 7.
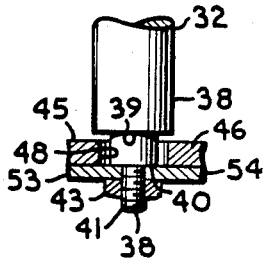
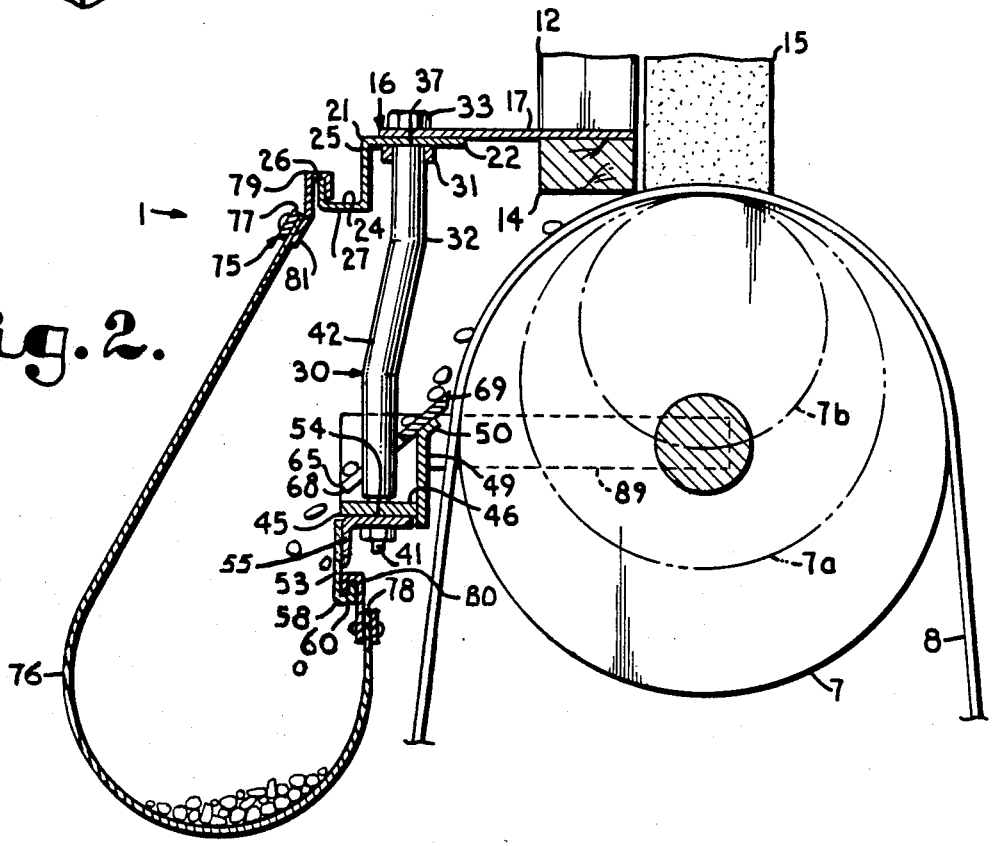
Fig. 2.

DEBRIS COLLECTOR FOR A WIDE BELT SANDER AND THE LIKE

BACKGROUND OF THE INVENTION

This is a continuation of my co-pending application Ser. No. 037,952 filed Apr. 13, 1987 now abandoned.

1. Field of the invention.

The present invention relates generally to debris collection, and in particular to a debris collector for a wide belt sander and the like.

2. Description of the Related Art.

Sanders with endless abrasive belts are widely used on various types of work pieces. For example, lumber is often dimensioned and surface dressed with wide belt sanders. However, the abrasive belts tend to become clogged or "loaded" with particles of the work piece material and require replacement or cleaning for satisfactory operation.

A wide belt sander cleaning device is disclosed in U.S. Pat. No. 4,720,939, which is assigned to a common assignee herewith. The device shown therein includes a crepe rubber cleaning block which is automatically reciprocated into and out of contact with an abrasive belt. Upon contact with a material-loaded abrasive belt, the crepe rubber of the cleaning block combines with the work piece material under heat and pressure and the work piece material is extracted to restore the abrasive belt to a more usable condition.

The debris comprising crepe rubber and work piece material, which often takes the form of small balls or particles, presents a maintenance problem since it can interfere with the operation of the sander if allowed to accumulate. The present invention addresses this problem.

Vacuum systems have heretofore been proposed for removing debris and dust from sanding and grinding operations. For example, the Cothrell et al. U.S. Pat. No. 4,525,955 discloses an abrasive belt cleaning system wherein an abrasive belt is subjected to intermittent blasts of compressed gas. The particles dislodged thereby are collected within dust hoods by pickups for removal by a source of vacuum.

However, heretofore there has not been available a debris collector with the advantages and features of the present invention.

SUMMARY OF THE INVENTION

In the practice of the present invention, a debris collector is provided for a wide belt sander having a housing, an upper idler roller, and a sanding belt reeved over the roller. The debris collector includes an upper assembly connected to the sander housing and a post assembly including a center post and a pair of side posts each having upper and lower ends. The posts are connected at their upper ends to the upper assembly. The center post is pivotally connected at its lower end to a lower assembly and the lower ends of the side posts are adapted to engage the lower assembly to restrict the pivotal movement thereof. The lower assembly includes a deflector bar with an inner edge positioned in proximity to the sanding belt and an outer edge. A bag assembly is mounted on the upper and lower mounting sections of the upper and lower assemblies and includes an open end communicating with the deflector bar.

OBJECTS OF THE INVENTION

The principal objects of the present invention are: to provide a debris collector for a wide belt sander and the like; to provide such a collector which is particularly well adapted for use with a belt cleaning device; to provide such a collector which is adapted for mounting on the belt cleaning device; to provide such a collector which includes upper and lower assemblies with a bar assembly extending therebetween; to provide such a collector wherein the upper and lower assemblies are pivotably interconnected; to provide such a collector with a deflector bar adapted to follow the movements of an upper idler roller; to provide such a collector wherein the bag assembly is easily removed; and to provide such a collector which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a wide belt sander with a belt cleaning device and a debris collector embodying the present invention.

FIG. 2 is a longitudinal, cross-sectional view of the sander taken along line 2—2 in FIG. 1.

FIG. 7 is an enlarged elevational view of the debris collector particularly showing a post lower end thereof.

DETAILED DESCRIPTION OF THE INVENTION

Figure 3:
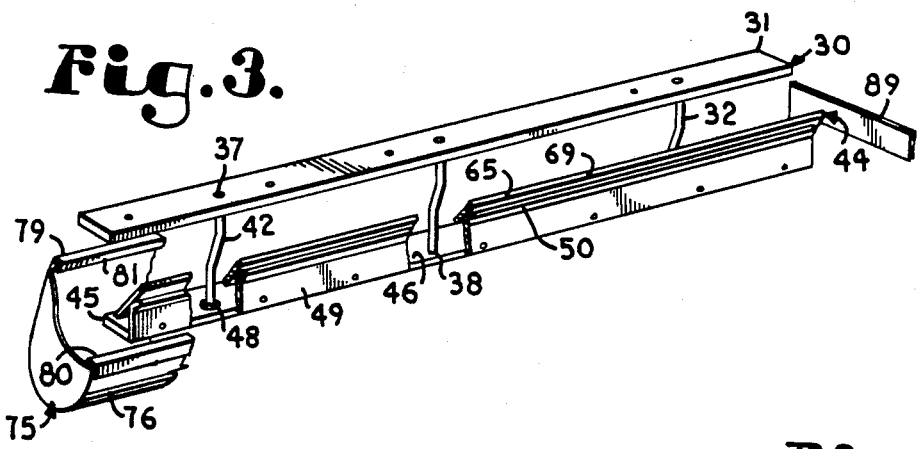
FIG. 3 is a perspective view of the debris collector.
Figure 4:
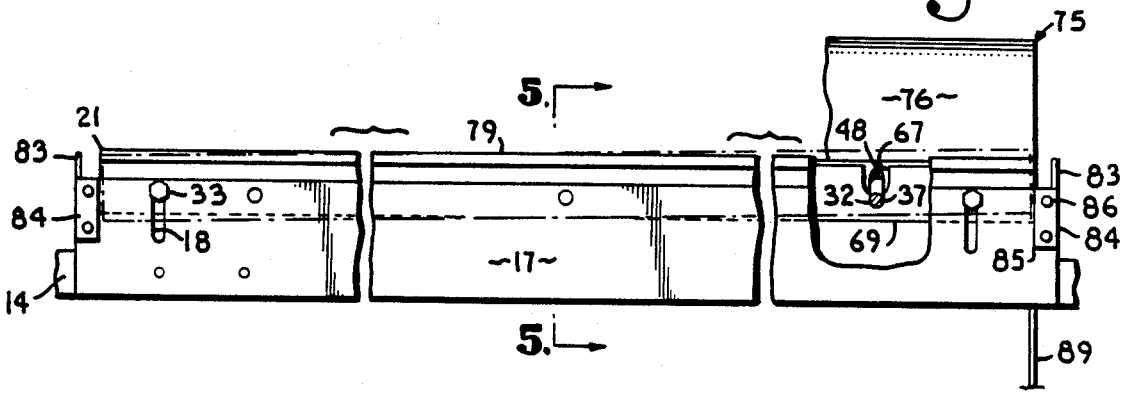
FIG. 4 is a top plan view of the debris collector.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of the description and without limitation, the invention is oriented transversely from side-to-side with respect to the wide belt sander and longitudinally from front-to-back with respect to the wide belt sander.

Referring to the drawings in more detail, the reference numeral 1 generally designates a debris collector embodying the present invention. The debris collector 1 is mounted on a wide belt sander 2 with a sheet metal housing 3 including a top panel 4. An upper idler roller 7 is located below the top panel 4 with an endless sanding belt 8 reeved thereover.

A belt cleaning device 11 is mounted on the sander housing to panel 4 and includes a main frame 12 projecting through an opening 13 in the top panel 4 and terminating at a wood strip 14 positioned in close proximity to the sanding belt 8. The belt cleaning device 11 includes a crepe rubber cleaning block 15 which also extends through the top panel opening 13 for reciprocation with respect to the upper idler roller 7 by a suitable mounting assembly (not shown).

The debris collector 1 includes an upper assembly 16 with a collector support plate 17 secured between the main frame 12 and the wood strip 14 and projecting outwardly therefrom. The collector support plate 17 has four longitudinally-extending, transversely-spaced slots 18. The upper assembly 16 also includes an upper mounting section 21 comprising a horizontal leg 22 with a plurality of receivers (not shown) aligned with respective slots 18 and an outer channel section 24 including proximate and distal vertical legs 25, 26 and a horizontal connecting leg 27. The channel section 24 is positioned outwardly with respect to the horizontal leg 22.

A post assembly 30 includes a transversely-extending bar 31 and a plurality of posts 32. A center post is designated 32*a*. The bar 31 is tapped to receive post assembly mounting bolts 33 which are inserted through the slots 18 and the horizontal leg 22 whereby the support plate 17, the upper mounting section 21, and the bar 31 are clamped together.

End posts 32 and center post 32*a* includes an upper end 37 welded to the bar 31 and a lower end 38 having proximate and distal shoulders 39, 40 and a threaded section 41. An intermediate portion 42 slopes outwardly from top to bottom whereby each post lower end 38 is positioned outwardly from a respective post upper end 37.

Figure 5:
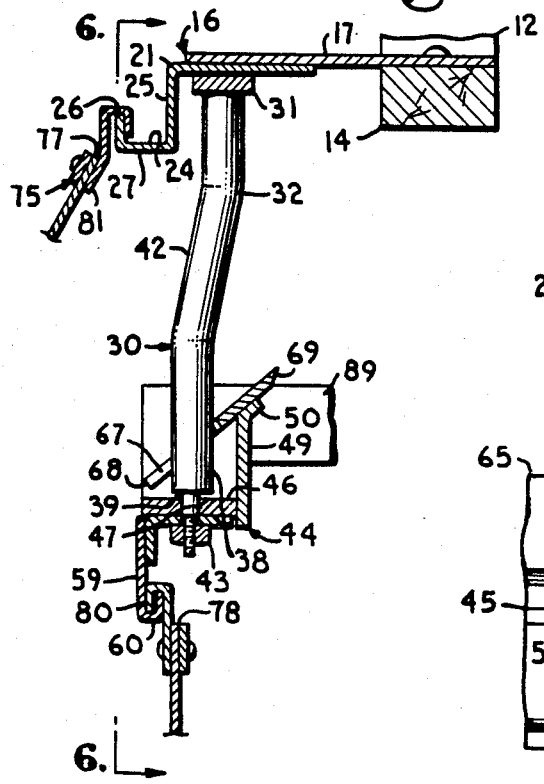
FIG. 5 is a longitudinal, cross-sectional view of the debris collector taken generally along line 5—5 in FIG. 4.
Figure 6:
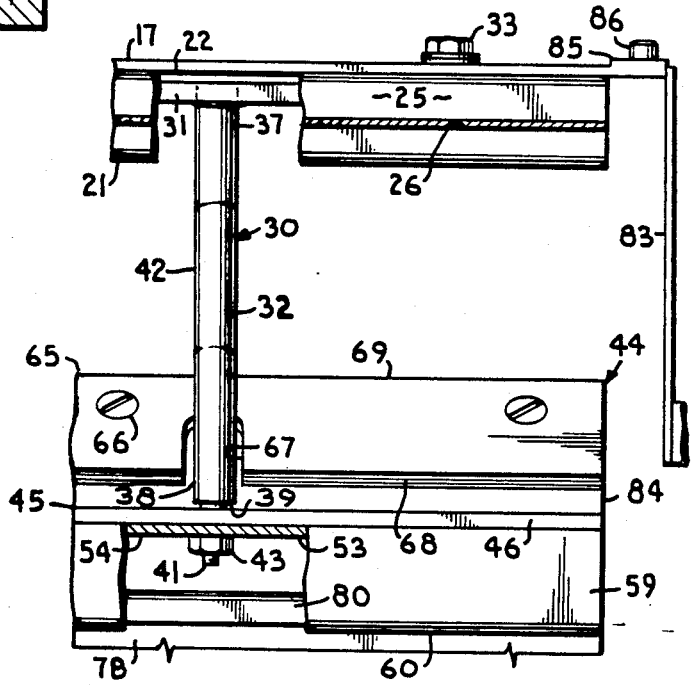
FIG. 6 is a transverse, cross-sectional view of the debris collector taken generally along line 6—6 in FIG. 5.

The post assembly 30 supports a lower assembly 44 including a pivot section 45 mounted on the post lower ends 38. The pivot section 45 includes a horizontal leg 46 with a center receiver 47 adapted to receive center post 32*a* and a pair of oversize end receivers 48 adapted to receive end posts 32; a vertical leg 49 positioned inwardly with respect to the horizontal leg 46 and extending upwardly therefrom; and a sloping leg 50 extending upwardly and inwardly from an upper edge of the vertical leg 49. The horizontal leg 46 is spaced slightly from the center post proximate shoulder 39 whereby the pivot section 45 is adapted to pivot with respect to the center post 32*a* (FIG. 5).

An angle section 53 includes a horizontal leg 54 mounted in abutment with the post lower end distal shoulders 40 and a vertical leg 55 depending downwardly from the horizontal leg 54 and positioned outwardly with respect thereto. Angle section 53 is held securely in position against distal shoulders 40 by nut 43 threaded to threaded section 41 of post 32. Pivot section 45 is positioned atop angle section 53 and is free to pivot in relation thereto. A lower mounting section 58 includes a vertical leg 59 mounted on an outer face of the angle section vertical leg 55 and a channel 60 at its lower end. A plastic deflector bar 65 is mounted on the pivot section sloping leg 50 by a plurality of screws 66 and includes a plurality of longitudinally-extending slots 67 open at an outer edge 68 of the deflector bar 65. Each receives a respective post 32 or 32*a*. The pickup bar 65 also includes a beveled inner edge 69 projecting inwardly from the sloping leg 50 in proximity to the sanding belt 8.

A bag assembly 75 includes a flexible plastic body 76 with upper and lower edges 77, 78. Bag assembly 75 can be a flexible open-ended bag with rigid ends to be installed by the user or can be manufactured originally with rigid closed ends. Upper and lower channel clips 79, 80 are mounted on the upper and lower mounting section channels 24, 60 respectively. Upper mounting channel clip 79 includes a slanted leg 81, slanting away from post assembly 30. A pair of side plates 83, cut to fit, are mounted on opposite sides 84 of the debris collector 1 and each includes a mounting flange 85 secured to the upper mounting section horizontal leg 22 by a pair of screws 86. A pivot follower bar 89 is secured to the pivot section 45 at one side 84 of the debris collector 1 and is connected to a corresponding end of the upper idler roller 7.

Alternatively, pivot section 45 and idler roller 7 may be interconnected by a two-piece structure comprising a first generally "L" shaped section having a leg attached to one end of pivot section 45 and a second leg extending in the same plane as pivot section 45, being generally parallel to idler roller 7. A second section has a longitudinally extending leg connected at one end to idler roller 7 and presenting at its other end a depending leg having a slot to receive the extending leg of the first section therein. This interconnection allows the pivot section to pivot in response to the movement of the upper idler roller 7 and is especially useful on sanding devices having idler rollers adapted for vertical movement.

The collector support plate slots 18 and corresponding receivers in leg 22 permit longitudinal adjustment of the position of the debris collector 1 with respect to the sander 2 whereby the deflector bar inner edge 69 is positioned in close proximity to the sanding belt 8. Post assembly 30 is positioned the desired distance from sanding belt 8 and securely held in place by post assembly mounting bolts 33. This allows for longitudinal movement of post assembly 30 and lower assembly 44 without movement of upper assembly 16. Wide belt sanders have upper idler rollers of various diameters, e.g. four inches (FIGS. 2, 7*b*), six inches (FIGS. 2, 7*a*) and eight inches (FIGS. 3, 7); and the debris collector mounting section 21 is adapted to accommodate such differences in upper idler roller diameter.

In operation, the pivot section 45 permits rotation of the lower part of the debris collector 1 through a relatively limited range of movement about a pivotal axis extending vertically through the lower end 38 of the center post 32*a*. Because the nuts 43 are clamped against horizontal leg 54 and the post distal shoulders 40, but not against the pivot section horizontal leg 46, the latter is free to rotate through an arc of movement limited by the post lower end 38 in the pivot section oversize end receivers 48.

Debris comprising material from a workpiece and the cleaning block 15 is diverted from the sanding belt 8, which moves in a counterclockwise direction, into the bag assembly 75 by the deflector bar 64. The bag assembly 75 can be removed for dumping or replacement from the debris collector side 84 which does not include the pivot follower bar 89, from which side the sanding belt 8 can also be changed.

It is to be understood that while certain forms of the present invention have been illustrated and described herein, it is not to be limited to the specific forms or arrangements of parts described and shown.

Having thus described the invention, what is claimed is:

1. A debris collector for a device with a moving, abrasive, workpiece-engaging surface, which comprises:

a first assembly connected to said device;

a second assembly positioned in spaced relation from said first assembly;

assembly connection means adapted to pivotally interconnect said assemblies;

a bag assembly comprising a flexible material having first and second ends connected to said first and second assemblies respectively, said bag assembly having an opening between said first and second assemblies; and said second assembly including a deflector bar in proximity to said abrasive surface and communicating with said bag assembly opening, said deflector bar being adapted to deflect debris from said abrasive surface into said bag assembly.

2. The collector according to claim 1 wherein:

said device comprises a wide-belt sander with an endless sanding belt having said abrasive surface.

3. The collector according to claim 1 wherein:

said first and second assemblies include first and second plates respectively; and said assembly connection means comprises a plurality of posts each having an upper end connected to said first plate and a lower end connected to said second plate.

4. The collector according to claim 3 wherein:

said second plate is pivotally connected to one of said posts.

5. In combination with a wide belt sander including a housing, an upper idler roller and an endless sanding belt reeved over said upper idler roller, the improvement of a debris collector including:

an upper assembly including a plate connected to said housing and a channel;

a post assembly connected to said plate and including a plurality of posts each having an upper end connected to said plate and a lower end;

a lower assembly pivotally connected to one of said post lower ends and including a channel;

said lower assembly including a deflector bar having an inner edge positioned in proximity to said upper idler roller and an outer edge; and a bag assembly including a flexible body with upper and lower edges, upper and lower channel clips attached to said body upper and lower edges and to said upper and lower assembly channels and an opening at said deflector bar inner edge.

6. The collector according to claim 5, which includes:

adjustment means adapted for adjusting the longitudinal position of said upper assembly with respect to said upper idler roller.

7. The collector according to claim 5 wherein:

said upper idler roller is pivotable with respect to said housing about a vertical pivotal axis; and said lower assembly is pivotally interconnected with said upper idler roller for pivoting therewith about a parallel vertical pivotal axis.

8. The collector according to claim 5 wherein:

said post assembly includes a bar connected to said post upper ends and to said upper assembly plate.

9. The collector according to claim 5, which includes:

said one post comprising a center post;

a pair of end post positioned on either side of said center post; and said lower assembly including a pivot section having a horizontal leg and a center receiver pivotally receiving said center post lower end and a pair of end receivers each receiving a respective end post lower end.

10. The collector according to claim 9 wherein:

each said end receiver is substantially larger than a respective post lower end received therein whereby said pivot section is adapted to pivot with respect to a vertical pivotal axis extending through said center post lower end and said pivotal movements of said pivot section are limited by said end receivers engaging said end post lower ends.

11. In combination with a wide belt sander including:

a housing with a top panel having an opening therein;

an upper idler roller positioned in spaced relation below said top panel;

a sanding belt reeved over said upper idler roller; and a belt cleaning device including a main frame extending through said top panel opening and a cleaning block reciprocable between a position engaging said sanding belt and a position disengaged therefrom;

the improvement of a debris collector, which comprises:

an upper assembly including a horizontal collector support plate mounted on said main frame and having a plurality of longitudinally extending slots, and an upper mounting section including a horizontal leg with receivers aligned with said collector support plate slots and a channel positioned outwardly with respect to said horizontal leg;

a post assembly including a bar having threaded receivers aligned with said upper mounting section receivers and said support plate slots and a center and a pair of end posts each having an upper end connected to said bar, and intermediate section sloping outwardly and downwardly from said upper end and a lower section with proximate and distal shoulders and a threaded section;

a plurality of bolts each extending through respective support plate slots and upper mounting section receivers, each said bolt being threadably received in a respective bar receiver whereby said upper mounting section and said bar are longitudinally movably mounted on said support plate;

a lower assembly including:

a pivot section including a horizontal leg with a center receiver adapted to pivotably receive said center post lower end and a pair of end receivers each being substantially larger than a respective end post lower end;

a vertical leg extending upwardly from said horizontal leg and positioned inwardly with respect thereto;

a sloping leg extending upwardly and inwardly from said vertical leg; and said pivot section being pivotable about a vertical pivotal axis extending through said middle post lower end with pivotal movements of said pivot section being limited by engagement between said end post lower ends and said pivot section end receivers;

a lower mounting section including a vertical leg connected to said lower assembly and a channel;

a deflector bar mounted on said pivot section sloping leg and including an inner edge positioned in proximity to said sanding belt, an outer edge; and said deflector bar having a center slot and a pair of end slots open at said deflector bar outer edge and each receiving a respective post; a bag assembly including:

a flexible body with upper and lower edges; upper and lower channel clips each connected to a respective body edge and a respective mounting section channel;

an opening communicating with said deflector bar;

opposite debris collector sides mounted on said support plate; and a pivot follower bar connected to said lower assembly at a respective collector side and to said upper idler roller at a corresponding side thereof.

* * * * *